US006907634B2

(12) United States Patent
Kobayashi et al.

(10) Patent No.: US 6,907,634 B2
(45) Date of Patent: Jun. 21, 2005

(54) PATTERNING SYSTEM USING A LIMITED NUMBER OF PROCESS COLORS

(75) Inventors: Seiin Kobayashi, Yamagata (JP); Yoko Zaikawa, Yamagata (JP); Ronald Magee, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 371 days.

(21) Appl. No.: 10/132,464

(22) Filed: Apr. 25, 2002

(65) Prior Publication Data

US 2002/0162176 A1 Nov. 7, 2002

Related U.S. Application Data

(60) Provisional application No. 60/287,772, filed on May 1, 2001.

(51) Int. Cl.[7] ..... D06B 1/02

(52) U.S. Cl. ..... 8/148; 8/149; 8/151; 68/205 R; 68/5 B

(58) Field of Search ..... 8/149, 148, 151, 8/158; 68/205 R, 200, 5 B; 118/696, 697; 700/130, 131, 132, 133

(56) References Cited

U.S. PATENT DOCUMENTS

| | | | | | |
|---|---|---|---|---|---|
| 3,722,434 | A | * | 3/1973 | Strother et al. | 112/80.23 |
| 3,868,779 | A | | 3/1975 | Wilt, Jr. et al. | 34/54 |
| 3,937,045 | A | | 2/1976 | Klein et al. | 66/205 R |
| 3,942,342 | A | | 3/1976 | Klein et al. | 68/205 R |
| 3,969,779 | A | | 7/1976 | Stewart, Jr. | 8/149 |
| 4,033,154 | A | | 7/1977 | Johnson | 68/205 R |
| 4,034,584 | A | | 7/1977 | Klein et al. | 68/205 R |
| 4,084,615 | A | | 4/1978 | Klein et al. | 137/624.11 |
| 4,116,626 | A | | 9/1978 | Varner | 8/149 |
| 4,146,362 | A | | 3/1979 | Nichols, Jr. | 8/485 |
| 4,216,735 | A | | 8/1980 | McDaniel, Jr. | 112/410 |
| 4,545,086 | A | | 10/1985 | Varner | 8/151 |
| 4,923,743 | A | | 5/1990 | Stewart, Jr. | 427/288 |
| 4,979,380 | A | * | 12/1990 | Robbins et al. | 68/250 R |
| 5,058,174 | A | * | 10/1991 | Carroll | 382/111 |
| 5,116,243 | A | * | 5/1992 | Wills | 8/149.2 |
| 5,128,876 | A | | 7/1992 | Cox | 364/470 |
| 5,208,592 | A | * | 5/1993 | Johnson, Jr. | 341/63 |
| 5,252,378 | A | * | 10/1993 | Mehta et al. | 428/195.1 |
| 5,303,069 | A | * | 4/1994 | Speciner | 358/3.1 |
| 5,354,342 | A | * | 10/1994 | Jenkins | 8/481 |
| 5,375,193 | A | | 12/1994 | Adams, Jr. | 345/603 |
| 5,428,720 | A | | 6/1995 | Adams, Jr. | 345/604 |
| 5,455,600 | A | | 10/1995 | Friedman et al. | 345/153 |
| 5,693,395 | A | * | 12/1997 | Wine | 428/49 |
| 5,734,368 | A | | 3/1998 | Meyers et al. | 345/155 |
| 5,966,454 | A | * | 10/1999 | Thomas et al. | 382/111 |
| 6,142,619 | A | * | 11/2000 | Miura et al. | 347/101 |
| 6,181,816 | B1 | | 1/2001 | Adams, Jr. et al. | 382/162 |
| 6,704,610 | B2 | | 3/2004 | West et al. | 700/133 |
| 6,792,329 | B2 | | 9/2004 | Adams, Jr. et al. | 700/133 |
| 2002/0074075 | A1 | * | 6/2002 | Brown et al. | 156/94 |

FOREIGN PATENT DOCUMENTS

| | | | |
|---|---|---|---|
| GB | 2353489 | * | 2/2001 |
| JP | 200296357 | * | 10/2000 |
| WO | WO97/10569 | * | 3/1997 |

* cited by examiner

*Primary Examiner*—Frankie L. Stinson
(74) *Attorney, Agent, or Firm*—Terry T. Moyer; George M. Fisher, III

(57) ABSTRACT

A process by which dithering techniques and in situ blending techniques may be used to reproduce a desired multi-colored dyed pattern on a substrate using precisely delivered quantities of liquid colorants that are available in only a relatively few colors. Specific preferred process colors, as well as procedures for expanding the range of reproduced colors using such process colors, are presented Optionally, specific actuation instructions for a specific dye injection machine capable of patterning a moving textile substrate may be generated.

30 Claims, No Drawings

PATTERNING SYSTEM USING A LIMITED NUMBER OF PROCESS COLORS

CROSS REFERENCE TO RELATED APPLICATIONS

This application is based upon provisional application 60/287,772 filed on May 1, 2001.

This disclosure relates to a process by which a desired multi-colored dyed pattern may be designed and placed on a substrate using precisely delivered quantities of liquid colorants that are available in only a relatively few colors. Specifically, this disclosure relates to a process by which relatively few liquid colorants, collectively comprising a limited selection of process colors, may be used, together with color-expanding techniques, to design and apply to a selected textile substrate an electrically-encoded pattern having a relatively wide range of colors. In a preferred embodiment incorporating the process disclosed herein, specific actuation instructions for a specific dye injection machine capable of patterning a moving textile substrate may be generated.

BACKGROUND AND SUMMARY OF THE INVENTION

Of the various methods that may be used to apply a pattern of colorants (dyes) to a textile web, arguably the most versatile method involves the pixel-wise application of various measured quantities of dyes, under the control of a computer containing a patterning program, to form multi-colored patterns using a predetermined set of primary or process colors. Examples of such pattern generation techniques may be found in commonly assigned U.S. Pat. Nos. 3,942,342; 3,969,779; 4,033,154; 4,116,626; 4,545,086; 4,894,169; 4,984,169; 5,128,876; 5,136,520; 5,142,481; 5,195,043; and 5,208,592.

Although a variety of patterning machines may be used to practice the teachings herein, it is important that the patterning machine be capable of applying colorants in accordance with electronically-encoded patterns and patterning instructions that are based on the pixel-wise assignment of various colors to the substrate to be patterned. Machines embodying the patterning techniques described in the above-listed patent documents are particularly well-adapted for patterning textile substrates in this manner.

Such machines consist fundamentally of a plurality of fixed arrays of individually controllable dye applicators or jets, each array being supplied by a respective liquid dye supply system carrying liquid dye (known as a "process colorant") of a specified color (known as a "process" color). Because the jets on each array are capable only of dispensing the liquid dye supplied to that array, the maximum number of different colorants that can be directly applied to the substrate by the machine (i.e., the maximum number of process colors) in a given pass can be no greater than the number of arrays. However, as will be explained below, the number of colors that can be made to appear on the substrate can be much larger than the number of process colors. As used throughout, the terms "process colors" and "process colorants" shall be used interchangeably, with the context indicating when the physical colorant in intended and must be inferred.

The arrays are positioned in parallel relationship, spanning the width of the path taken by the substrate to be patterned (i.e., generally perpendicular to the direction of web travel). As the substrate moves along its path, it passes under each of the arrays in turn and receives, at predetermined locations on the substrate surface (i.e., at the pixel locations specified by the pattern data), a carefully metered quantity of dye dispensed from one or more of the dye jets spaced along the array. The control system associated with the machine provides for the capability of delivering a precise quantity of dye (which quantity may be varied in accordance with the desired pattern) at each specified location on the substrate as the substrate moves under each respective array, in accordance with electronically-defined pattern information.

To facilitate the descriptions that follow, different definitions of "color" will be referenced. The term "target color" will refer to the desired color to be reproduced on the substrate. The term "process color" will refer to the inherent color of the individual, unblended dye or other colorant that is supplied to each of the individual dye jets comprising a given array, and that may be directly applied in pixel-wise fashion to the substrate. Note that the same process color may have a different visual appearance on different substrates, due to inherent substrate color, substrate texture, etc. Collectively, the assortment of process colors available for use by a pattering device at any given time is referred to as a "colorway."

Consistent with the above, as used herein the term "pixel" shall refer to the smallest area or location in a pattern or on a substrate that can be individually addressable or assignable with a given color. Alternatively, if clear from the context, the term "pixel" shall refer to the smallest pattern element necessary to define the line elements of the pattern to a predetermined level of detail, analogous to the pixel counts in imaging device resolution specifications (e.g., 1280×1024). It is assumed, unless otherwise stated, that the pixels that comprise the desired pattern correspond to the pixels into which dye may be delivered on the substrate by the patterning device.

Among the techniques used by the applicant in jet dyeing or printing to extend the range of reproduced colors from a limited number of process colors (e.g., the number of gun bars in the patterning apparatus) are two techniques that shall be referred to herein as dithering techniques and in situ bending techniques. Either of these two techniques are well suited to systems in which the observed patterns are comprised of small quantities of colorant that are deposited in contiguous, pixel-wise fashion, across the surface of the substrate.

Dithering techniques are based upon the phenomenon that a color for which no exact match is available among the process colors can be visually approximated, frequently to a high degree of accuracy, by the juxtaposition of several individual pixels, each having a color that expresses a visual component of the desired or target color. When viewed at an appropriate distance, the eye tends to visually integrate or blend the individual contribution of each pixel in this group of adjacent pixels and provides the perception of a color that has been "constructed" from an imperceptible mosaic of related colors. As used herein, halftone methods (e.g., checkerboard patterns of colors that yield a representation of a desired color that is unavailable as a process color) shall be considered a form of dithering.

The term "perceived color" shall refer to the color of a small area of a substrate in which a target color has been simulated using dithering techniques, wherein the colors of adjacent individual pixels are visually integrated by the eye of the observer to form a visual blend. For example, generating the color green can be achieved by constructing an array of alternating blue and yellow pixels in a mosaic or checkerboard pattern. At a distance beyond which the individual blue and yellow pixels can no longer be perceived, the result is an area having a surprisingly uniform green coloration.

Generalizing this technique to accommodate unequal proportions or distributions of pixels that share a common color, a wide variety of colors can be generated using various arrangements and relative proportions of pixels that collectively are of two or more colors. For example, various shades of green can be reproduced with appropriate arrangements and relative proportions of blue pixels and yellow pixels. Similarly, given the availability of a "medium" blue as a process color, a variety of shades of blue, ranging from a powder blue (light blue) to a navy blue (dark blue), can be reproduced (when viewed at an appropriate distance) by using various arrangements and proportions of pixels that are colored white and blue (yielding a light blue) and black and blue (yielding a dark blue), with the relative number of white or black pixels comprising the mosaic determining the perceived relative lightness or darkness of the overall dithered pattern area. In connection with such dithering or halftone techniques, the term "heather" or "stipple" shall be used to describe the relative granularity of the image, where the eye is able to distinguish the individual pixels or groups of pixels that comprise the mosaic (i.e., dithered) area.

As distinguished from dithering techniques, in situ blending techniques do not depend upon the formation of a mosaic of different pixels that must be visually integrated to form the desired target color. Rather, these techniques strive to form the desired color on the substrate through the physically mixing or blending of the applied liquid colorants in a pre-defined area (e.g., within a pixel) on the substrate.

The creation of various colors on such substrates with liquid dyes, particularly using the dye injection method described above, is greatly influenced by the generally absorbent nature of textile substrates. Accordingly, it should be understood that, as used herein, the term "concentration" is intended to refer to the relative volumetric absorption of liquid colorant by the substrate (i.e., the degree of physical saturation), and not the relative dilution or chromophore content of the liquid colorant—i.e., a colorant applied to a pixel at a 50% concentration means that the substrate area defined by that pixel has only been saturated to one half its capacity to absorb colorant, and additional colorant(s) may be applied to that pixel without exceeding the absorptive capacity of the substrate at that location.

The term "blended color" shall be used where quantities of two or more colorants occupy at least portions of the same pixel-sized location on a substrate; the term "blended color" shall refer to the color of the physical combination or in situ blending of those two or more colorants, as viewed at the individual pixel level. Accordingly, if the color green is to be reproduced in a given area and only yellow and blue colorants are available as process colors, the designer may (providing the patterning device is capable) elect to construct that green by delivering a predetermined quantity of yellow as well as a predetermined (and not necessarily equal) quantity of blue, in a specified sequence to each pixel comprising the "green" area rather than constructing the green using the dithering (checkerboard or mosaic) method described above. By varying the sequence and relative proportion of the component colorants that are delivered to the same pixel and allowed to mix, a variety of shades or hues may be reproduced. Unlike the use of dithering, where the target color exists only in the eye of the observer, rather than on the substrate, in situ blending techniques are capable of generating individual pixels in which the colors are in fact distinctly different from the process colors, and that may provide for the accurate reproduction of the target color without the need for dithering.

Where an extremely broad range of target colors must be available from the use of a limited number of available or primary colors, i.e., from a limited colorway, it has been found advantageous to combine these techniques, thereby forming dithered structures that are comprised of individual pixels in which in situ blending may have occurred. Such in situ blending may be the result of migration of colorants from one pixel containing a colorant to an adjoining pixel containing a different colorant ("inter-pixel blending"), the placement of two or more different colorants within the same pixel ("intra-pixel blending"), or a combination of these two techniques, in which the inter-pixel colorant migration involves at least one pixel into which two or more individual colorants have been delivered by the patterning device. This provides for the possibility that, within a dithered structure, some pixels may carry the color of a process color, while others, in a proportion dictated by the relationship between the target color and the process colors, may carry a color that is the result of the physical blending of two or more of the process colors.

A specific embodiment of such in situ blending involves the oversaturation (i.e., more than 100% concentration) and undersaturation (i.e., less than 100% concentration) of adjacent pixels. If the quantity of colorant applied to a pixel area exceeds the ability of the substrate to absorb it, effectively oversaturating that pixel area, some quantity of colorant tends to diffuse or migrate beyond the boundaries of the pixel area to which the colorant was applied and occupy a portion of an adjacent pixel area, especially if that adjacent pixel area is relatively undersaturated, i.e., it has retained some unused colorant absorptive capacity. By providing an adjacent pixel area that is relatively undersaturated, it is possible to induce colorant migration from areas in which the colorant concentration (i.e., substrate saturation level) is excessively high to areas in which the colorant concentration remains below the saturation capacity of the substrate.

This migration of colorant will cause either a displacement of the color in an adjacent pixel area or a physical blending with the color in an adjacent pixel area. This migration can occur from pixel to pixel within a group of adjoining or contiguous pixels, as well as outwardly beyond the edge of the group, thereby causing colorant displacement or blending within the group as well as in areas immediately adjacent to the group. A group of adjoining or contiguous pixels containing at least one oversaturated pixel area and at least one adjoining or contiguous undersaturated pixel area (the respective numbers do not have to be equal), and which exhibits pixel-to-pixel colorant migration within the group, is herein defined as a metapixel.

Because it is frequently undesirable to oversaturate large areas of the substrate with colorant, the quantity of colorant directly applied to the adjacent pixels can be adjusted to accommodate the inter-pixel colorant migration in order to maintain the desired degree of average local substrate "wet out" or saturation level (i.e., concentration). This level is usually "100%" or full saturation without oversaturation, a level which generally assures full colorant penetration and maximum "cover." Generally, it is preferred that the overall level of oversaturation in a given localized area be balanced by a corresponding degree of undersaturation in the same area. Thus, if a given pixel is oversaturated to a level of, say 140%, one can establish, for example, one adjacent pixel with a concentration (i.e., saturation) level of 60%, or, alternatively, one could establish two adjacent pixels, each with a concentration level of 80%.

It should be noted that, in addition to oversaturating certain pixels with a single colorant, it is possible to achieve an oversaturated condition using partially saturating applications of two or more colorants within the same pixel. Doing so will generate a blend of the colors within the pixel, and will cause an inter-pixel migration of a combination of these colorants, again creating color blends that are beyond existing color generating techniques. Similarly, separate, partially saturating applications of two or more colorants can be assigned to a pixel that remains undersaturated. Such undersaturated pixel may remain undersaturated, or may play host to the migration of one or more colorants from an adjacent oversaturated pixel, perhaps reaching full saturation in the process, as the pixel-wise patterning instructions, and the underlying artistic considerations, may dictate.

It is also contemplated that the physical placement or arrangement of the individual component pixels—including those that are oversaturated or undersaturated—within the metapixel need not be fixed, but can be varied as needed to assist in emphasizing pattern boundaries, adjusting pattern definition, or for other reasons. The skillful construction and arrangement of the metapixel—including the adept choice of the initial colorants used, careful selection of the nature and degree of colorant oversaturation and migration employed, and the judicious placement and optimal systematic rearrangement of the individual pixels within the metapixel—can greatly expand the effective color palette possible from a given number of available colors and a limited ability to apply small quantities of colorant.

It should be understood that the techniques described herein are not limited to the specific in situ blending processes or blending patterning systems described above. For example, an arrangement of liquid colorant (e.g., dye) applicators, perhaps grouped in terms of color to be applied, may be physically moved or traversed across the path of a sequentially indexed substrate while dispensing measured quantities of dye. Although such arrangement is distinct from the fixed array systems discussed above, it is believed that the teachings herein are fully applicable to and adaptable for use with such systems, provided dye or colorant delivery can be controlled at the individual pixel level.

The techniques described herein are applicable to the patterning of a variety of substrates, but will be described in terms of an absorbent substrate such as a textile substrate. Such substrates can be, for example, tufted or bonded floor covering materials. Dye application techniques that may be considered include, but are not limited to, silk screen printing, offset printing, and various methods in which a stream of dye is directed onto the substrate surface. While the techniques described herein can be used in conjunction with a variety of printing systems, they are particularly well suited to systems in which the dyed image is formed by the precise delivery of an individually specified aliquot of liquid dye to a predetermined location (i.e., the pixel to be colored) on the substrate surface, such as those described in the commonly-assigned U.S. Patents referenced above. It should be understood that other textile substrates, such as decorative or upholstery fabrics, or other absorbent substrates, may also be used.

As is apparent from the foregoing discussion, it would be highly desirable to reproduce a wide range of colors from a minimum number of process colors. Although the use of dithering or in situ blending techniques are effective in greatly expanding the range of possible colors obtainable from a given set of process colors, the choice of such process colors—the specific colors of the process dyes—has been found to have a dramatic effect on the range of colors that can be achieved with a relatively limited number of process colors. Accordingly, it is believed that the process color sets described herein will allow for the reproduction of an unexpectedly large and unprecedented range of colors, particularly when used with the blending techniques described herein.

In one preferred embodiment, a jet dye patterning device is operated with process colorants that correspond to the respective primary colors of the additive (i.e., Cyan, Magenta, Yellow, or "CMY") and subtractive (i.e., Red, Green, Blue, or "RGB") systems to generate color, with the optional addition of one or more commonly-used neutral colors (e.g., black, beige, gray, and/or white). This yields a total process color palette or colorway comprised of cyan, magenta, yellow, red, green, blue, and one or more optional neutral colors. As a practical matter, the total number of process colors is preferably no greater than the number of individually available colors that can be placed on the substrate of interest in a single pass through the patterning device. In the patterning device disclosed in the U.S. patents referenced above, that number would correspond to the number of available gun bars.

Pre-specified in situ blended combinations of these process colors, assuming blends of 50/50 (i.e., sequential applications of two different colorants, each at a 50% concentration or relative saturation level) or some other proportion, also can be used as colors available to color individual pixels and therefore can be used effectively to augment the selected process color palette. In this embodiment, the individual process colors and the appropriate blends of such colors, taken together, comprise the total color palette available for coloring individual pixels. It is this palette, and dithered constructions using this palette, that support the range of colors that are available to the designer of patterns to be used on the substrates of interest, and that comprise an important aspect of the development described herein.

Additionally, in another embodiment, combinations of relatively dilute and concentrated colorants having a similar hue or inherent "color" (e.g., pink and red, or gray and black), or the use of a neutral diluent (which may be clear, white, light gray, light beige, brown, black, or other neutral "color") to generate in situ mixtures on the substrate that simulate such relative dilute/concentrated color pairs can be used if additional process colorant capacity (e.g., additional gun bars) is available. It has been found that the use of such dilute/concentrated color pairs can also serve to expand even further the range of the target colors that can be reproduced from certain palettes disclosed herein, especially when a relatively wide range of colors must be generated from a limited number of process colors.

DETAILED DESCRIPTION

In accordance with an exemplary embodiment, an initial step in using the system disclosed herein is determining the process colorants to be used, as well as the in situ blends that are available from specified combinations of such process colorants. The combination of these colorants will comprise the dithering palette, from which readily available dithering software can construct an even larger apparent palette of perceived colors. Commonly, 50/50 blends (i.e., two sequential applications of colorant in the same pixel, each at a 50% substrate saturation or relative absorption capacity level) involving two colorants are used, but blends that exhibit other relative proportions of two colorants, or blends that involve three or more colorants, may also be considered. These process colorants, together with the available in situ blends of such colorants, will comprise the palette from which an available dithering algorithm can construct a dithered image from the target image (i.e., the pattern to be reproduced on the substrate).

Generally, the greater the number of individual process colorants that can be accommodated by the patterning device, the wider the spectrum of reproduced colors on the substrate will be. Using the process color scheme disclosed herein, five process colorants—red, green, magenta, yellow, and a blue/cyan mixture nominally comprised of 50% blue and 50% cyan (the actual relative proportions may be varied, depending upon the target colors and the artistic effect desired)—have been found to represent a practical minimum number of process colors from which a reasonably wide dithering palette can be constructed. This combination will yield at least ten in situ blends (without consideration of inter-pixel blending), which results in a total of fifteen colors available for use in a dithering palette.

If six process colorants are available, the respective components of the blue/cyan mixture (e.g., blue and cyan) can be substituted for the mixture. Alternatively, and in some circumstances, preferably, it is foreseen that the selected blue/cyan mixture (perhaps using a modified proportion of blue and cyan) can be maintained, and a neutral colorant, for example taken from the group consisting of white, clear (i.e., an unpigmented diluent) light beige, light gray, medium gray, tan, brown, or black, can be added to the available process colors. The choice of which neutral to include may depend upon the nature of the patterns to be reproduced. Patterns requiring the reproduction of dark colors (e.g., deep burgundy, navy blue, forest green etc.) or black will benefit from a choice of black as the neutral colorant, while patterns that require pastels will benefit from a choice of white or clear as the neutral (to act as a chromatic diluent for the other process colors).

If seven or eight process colorants are available, it is suggested that the blue/cyan mixture again be maintained, and a second or third neutral color, taken from the group described above, be added to the available process colorants. With eight such process colorants, a visually distinctive array of 36 colors can be reproduced, using only the eight process colorants and 50/50 two-way blends of such colorants. It is also contemplated that, as may be required by the target colors to be reproduced, combinations of red and magenta, or yellow and green, can be developed and used in a manner similar to, and as a substitute for, the blue/cyan combination (e.g., as the "mixed" color in a five, six, seven, or eight process colorant system, thereby preserving the individual blue and cyan colors in those systems).

If nine process colorants are available, it is suggested that the respective individual components of the "mixed" color (e.g., blue and cyan) should be substituted for the mixture. With nine process colorants (comprising, for example, red, green, blue, cyan, magenta, yellow, light beige, light gray, and black), a visually distinctive array of 45 colors can be reproduced (9 process colors, plus 36 50/50 two-way blends). As with any selection of process colors, additional colors may be reproduced by using blends in addition to 50/50 two-way blends.

Extending beyond nine available process colorants, it is suggested that the nine process color palette be maintained, but augmented by additional neutral colors as dictated by the colors in the patterns to be reproduced. For example, using 12 process colors, one preferred set of process colors includes red, green, blue, cyan, magenta, yellow, white, light gray, medium gray, tan, and black, and (assuming use of only 50/50 two-way blends) will generate a total of 78 visually distinct colors. As an option, depending upon the colors required to be reproduced, it is also contemplated that pre-mixed dilute versions of certain standard process colors (e.g., pink) can be used as additional process colors, for use in addition to the counterpart standard process color (e.g., red) as a technique of extending the overall color space achievable with a given number of process colors. As may be required by the nature of the target colors (e.g., a preponderance of pastels), it is foreseen that the premixed versions of varying levels of relative dilution could extend to three or more levels, i.e., a pale, a light-to-moderate, and a "standard" or relatively saturated (in a chromatic sense) version of a given process color. Of course, the decision as to the specific choice of process colors, and specifically the balance between the number and choice of pre-diluted/standard colorant concentration pairs, if any, and the number and choice of neutral colors, should be made with the demands of the specific patterns and pattern colors to be reproduced in mind.

As a specific example of the above technique involving use of different dilutions of the same hue (e.g., pink and red, or light and medium blue), it is contemplated that a particularly wide range of commercially desirable colors can be produced from a set of five colors that includes standard dilutions of blue and cyan, along with red, gray, and yellow, with the latter three colors all at the same relative, but not necessarily standard, level of dilution. The process is begun by using relatively dilute colorant concentrations of these latter three colors. After producing all patterns having colors best suited to combinations of these five process colors, these three colorants can be purged from the patterning device simply by respectively introducing, all at one time, progressively less dilute colorant concentrations of these three colorants (e.g., more concentrated red, medium gray, and more concentrated yellow) to the respective applicators that previously contained the more dilute concentration of the same colorant. Because of the ability of darker or more concentrated colors to tend to mask the presence of lighter or less concentrated colors, the effects of changing colorants in this manner (i.e., from more dilute colorant concentrations to less dilute colorant concentrations of the same hue) tend to minimize any color abnormalities due to the presence of residual quantities of the less concentrated colorant. When the sequence is complete (say, after three progressively more concentrated versions of the three colorants have been introduced in turn in the patterning device, as, for example, when the red and the yellow have become quite saturated, and the gray has become black or nearly so), these last, most concentrated colorants can be purged from the applicators, the colorant conduits within the patterning device can be cleaned, and the use/purge cycle started anew. Note that, in this example, the blue and cyan colorants remain unchanged throughout these cycles.

It is foreseen that the technique of using a darker or less dilute colorant to purge a lighter or more dilute colorant can be used while the patterning device is in a production mode applying colorant to a substrate, or in a separate, off-line operation designed to minimize the time needed to change colorants. Furthermore the technique can be applied to any of the colorant configurations described herein, and can be used for one, several, or many of the colorants comprising the colorant supply for the patterning devices contemplated herein.

It is contemplated that other arrangements, using a different number of colorants wherein fixed dilutions of some colorants and progressively less dilute versions of other colorants are used in a use/purge cycle in which the less dilute colorant is simply used to purge the more dilute colorant from the patterning system, can be used. In this way, the range of colors that can be reproduced with a given number of process color applicators (e.g., gun bars) can be easily and effectively expanded, with minimal disruption to the colors intended to be reproduced on the substrate.

Once the selection of process colors is made, the selected process colors, and all appropriate blends of those colors (e.g., all 50/50 two-way blends, or all 75/25 two-way blends, and perhaps all 33/33/33 three-way blends, or other, specifically tailored proportional blends involving two, three, or more colorants) may be specified as comprising the dithering palette to be used in the graphics arts software of choice. In a preferred embodiment, there is a one-to-one correspondence between (1) the process colors and all appropriate in situ blends of such process colors and (2) the dithering palette used by the dithering algorithm. Examples of graphics arts software containing dithering algorithms believed to be suitable include Adobe Photoshop®, published by Adobe Systems Incorporated, San Jose, Calif.

Calibration of the monitor image to reflect the appearance of the colorants on the selected substrate (e.g., gamma correction) is recommended. Several methods to achieve this calibration may be used. Perhaps the most straightforward involves the use of a test blanket comprised of the substrate to be patterned, on which has been dyed swatches that represent, respectively, the application of all available process colors and all appropriate in situ blends of such colors. The test blanket therefore can serve to show the actual visual effect achieved with various colorant quantities and combinations. That visual effect can then be directly compared, by eye, with the representation of that color or color combination on the designer's monitor, and appropriate RGB-type chromatic adjustments can be made using the graphics design package (e.g., for example, Adobe Photoshop®). At the conclusion of this step, the colors of the test blanket swatches have been accepted by the designer as visual matches to the colors displayed on the computer monitor (which means that the colors represented on the computer monitor will have the same appearance as the colored areas comprising the desired pattern on the substrate), and those displayed colors become the dithering palette for the next stage in the design process.

Following the introduction or generation of the digitized image that will form the pattern or design to be reproduced on the substrate, the graphics arts software can generate a digitally processed, dithered image using the dithering palette developed in the prior step. In that dithered image, all individual pixels carry a process color or an appropriate blend of a process color. Target colors that are not matched to either of these sets of colors are synthesized by the dithering algorithm in the graphics arts software. The result is a displayed version of the desired pattern in which the displayed image closely resembles the appearance of the patterned substrate. In that displayed image, all target colors of the pattern have been reproduced (to a greater or lesser degree of accuracy, depending on the number of process colorants available, the desired resolution or degree of heather, and the inherent color of the substrate, among other factors) using only process colorants and appropriate blends of process colorants. Additionally, due to the use of the test blanket, the designer has some assurance that displayed process colors (and appropriate, specified blends of such colors) will correspond closely to the colors actually produced by the patterning device as it patterns the selected substrate.

Upon approval of the designer, the digitally processed computer display image, as expressed in the colors of the dither palette by the graphics arts software, may be translated into specifications or operating instructions for the patterning device. This process, when used with appropriately compatible automated hardware, is capable of providing for the automated manufacture of the patterned substrate, as that patterned substrate appeared at the designer's monitor.

The translation process can be achieved most straightforwardly by creating in appropriate software a look-up table, perhaps with the use of a test blanket (as described earlier), on which has been dyed color swatches that represent respectively the application of all available process colors and all appropriate in situ blends of such colors. If used to refine the dithering palette, as described above, this same test blanket (or, more specifically, the dye jet firing time data that generated the various color swatches on the test blanket) can be used to generate an appropriate look-up table that associates a given color or color combination with a set of dye applicator-specific firing instructions. Preferably, this look-up table can then be accessed by the electronic control system of the patterning device to "translate" a desired color at a given pixel location in the pattern with the proper dye delivery quantities and sequences to generate that color on the substrate at that specific pixel location. It may be necessary to store the results of the table look-up to assure that the appropriate instructions for each colorant applicator on each gun bar reach the proper applicator at the proper time—when the location on the substrate to be colored by that applicator is passing under that applicator.

The preferred embodiments described above are intended to be by way of example only. It is anticipated that modifications to the above that fall within the scope of the present invention will be apparent from the above description. The present invention is to be limited not by that description, but rather by the scope of the following claims.

We claim:

1. A method for generating a multi-colored pattern on an absorbent substrate with an electronically-actuated patterning device, said pattern being defined and generated as an array of individually colored pixels on said substrate, said patterning device having a relatively small number of available process colors and said pattern exhibiting a substantially greater number of colors than the number of said process colors, said method comprising the steps of:

a) making available a multi-colored target pattern in digitized form to be reproduced on said substrate;

b) selecting the process colors to be used by said patterning device to reproduce said target pattern, said process colors comprising red, green, magenta, yellow, and at least one other color;

c) establishing a dithering palette comprised of said process colors;

d) generating, on a display device, a dithered image of said target pattern using said dithering palette; and e) transforming said dithered image into pixel-wise patterning instructions for said patterning device.

2. The method of claim 1 wherein said absorbent substrate is a textile floor covering, and wherein step e) is followed by step of): selectively dispensing liquid colorants corresponding to said process colors onto said floor covering substrate in accordance with said patterning instructions to reproduce said target pattern on said floor covering substrate.

3. The method of claim 2 wherein said patterning device is capable of generating in situ blends of process colorants on said substrate by the selective dispensing of at least two colorants within a single specified pixel.

4. The method of claim 3 wherein said process colors and said in situ blends are observed on said display device and visually matched to a test blanket having swatches of said process colors and said blends, as reproduced by said patterning device, prior to the establishment of said dithering palette.

5. The method of claim 3 wherein said in situ blends include the formation of colors on said substrate that result from the migration of process colorants beyond the boundaries of the pixel into which such process colorants were dispensed.

6. The method of claim 5 wherein said color formation comprises the selective formation by said patterning device of oversaturated pixels on the substrate, the selective formation by said patterning device of undersaturated pixels immediately adjacent to said oversaturated pixels, and the migration of process colorants from said oversaturated pixels to said undersaturated pixels.

7. The method of claim 6 where in at least one oversaturated pixel has been formed by the dispensing by said patterning device of at least two different process colorants within said oversaturated pixel.

8. The method of claim 3 wherein the selected process colors include at least five process colors, and wherein said process colors are comprised of red, green, magenta, yellow, and a color that represents a combination of blue and cyan.

9. The method of claim 3 wherein the selected process colors include at least six process colors, and wherein said process colors are comprised of red, green, magenta, yellow, a color that represents a combination of blue and cyan, and one color selected from the group consisting of white, clear, black, light beige, light gray, medium gray, and tan.

10. The method of claim 3 wherein the selected process colors include at least seven process colors, and wherein said process colors are comprised of red, green, magenta, yellow, a color that represents a combination of blue and cyan, and two colors selected from the group consisting of white, clear, black, light beige, light gray, medium gray, and tan.

11. The method of claim 3 wherein the selected process colors include at least eight process colors, and wherein said process colors are comprised of red, green, magenta, yellow, a color that represents a combination of blue and cyan, black, light beige, and light gray.

12. The method of claim 11 wherein said process colors and said blends are observed on a monitor and visually matched to a test blanket having swatches of said process colors and said blends, as reproduced by said patterning device, prior to the establishment of said dithering palette.

13. The product of the process of claim 11, wherein said in situ blends include the formation of colors on said substrate that result from the migration of process colorants beyond the boundaries of the pixel into which such process colorants were dispensed.

14. The method of claim 13 wherein said color formation comprises the selective formation by said patterning device of oversaturated pixels on the substrate, the selective formation by said patterning device of undersaturated pixels immediately adjacent to said oversaturated pixels, and the migration of process colorants from said oversaturated pixels to said undersaturated pixels.

15. The method of claim 3 wherein the selected process colors include at least nine process colors, and wherein said process colors are comprised of red, green blue, magenta, cyan, yellow, black, light beige, and light gray.

16. The method of claim 15 wherein said patterning device has greater than nine process colors, and wherein said process colors are additionally comprised of at least one color selected from the group consisting of white, clear, medium gray, and tan.

17. The product of the process of claim 16, wherein said in situ blends include the formation of colors on said substrate that result from the migration of process colorants beyond the boundaries of the pixel into which such process colorants were dispensed.

18. The method of claim 17 wherein said color formation comprises the selective formation by said patterning device of oversaturated pixels on the substrate, the selective formation by said patterning device of undersaturated pixels immediately adjacent to said oversaturated pixels, and the migration of process colorants from said oversaturated pixels to said undersaturated pixels.

19. The product of the process of claim 15, wherein said in situ blends include the formation of colors on said substrate that result from the migration of process colorants beyond the boundaries of the pixel into which such process colorants were dispensed.

20. The method of claim 19 wherein said color formation comprises the selective formation by said patterning device of oversaturated pixels on the substrate, the selective formation by said patterning device of undersaturated pixels immediately adjacent to said oversaturated pixels, and the migration of process colorants from said oversaturated pixels to said undersaturated pixels.

21. A method for generating a multi-colored pattern on an absorbent substrate with an electronically-actuated patterning device, said pattern being defined and generated as an array of individually colored pixels on said substrate, said patterning device having a relatively small number of available process colors and said pattern exhibiting a substantially greater number of colors than the number of said process colors, said method comprising the steps of:

a) making available a multi-colored pattern in digitized form to be reproduced on said substrate;

b) selecting the process colors to be used by said patterning device, said process colors comprising cyan, blue, red, yellow, and gray;

c) establishing a dithering palette comprised of said process colors and blends of said process colors;

d) generating a dithered image of said target pattern using said dithering palette; and e) transforming said dithered image into pixel-wise patterning instructions for said patterning device.

22. The method of claim 21 wherein said method further comprises the steps of:

f) introducing process colorants corresponding to said process colors into said patterning device and applying said process colorants to said substrate in pixel-wise fashion in accordance with said patterning instructions.

23. The method of claim 22 wherein said patterning device is capable of generating in situ blends of said process colorants on said substrate by the selective dispensing of at least two of said colorants within a single specified pixel.

24. The method of claim 23 wherein said method further comprises the steps of:

g) defining a set of process colorants, said set being comprised of at least two of said process colorants that are to be removed from the colorway of said patterning device; and h) replacing each process color comprising said set by substituting into said patterning device a respective replacement process colorant, said replacement colorant having a similar but more intense hue than the corresponding process colorant it replaces.

25. The method of claim 24 wherein said replacement process colorants are substituted by introducing said replacement colorants into said patterning device before the supply of process colorants comprising said set within the patterning device is exhausted.

26. The method of claim 25 wherein said in situ blends include the formation of colors on said substrate that result from the migration of process colorants beyond the boundaries of the pixel into which such process colorants were dispensed.

27. The method of claim 26 wherein said color formation comprises the selective formation by said patterning device of oversaturated pixels on the substrate, the selective formation by said patterning device of undersaturated pixels immediately adjacent to said oversaturated pixels and the migration at process colorants from said oversaturated pixels to said undersaturated pixels.

28. The method of claim 24 wherein said set is comprised of process colorants corresponding to the process colors red, gray and yellow.

29. A method for imparting a pattern to an absorbent substrate with an assortment of process colorants, said colorants being applied in pixel-wise fashion by a patterning device in which liquid colorants of different colors are directed through respective liquid applicators onto a substrate, each of said applicators being supplied with a colorant of a specific color, wherein a first colorant, having been supplied to at least one applicator, is replaced in said applicator by a second colorant before said first colorant is purged from said applicator, said second colorant having a similar hue but a greater chromatic intensity than said first colorant, and wherein the transition between the use of said first colorant and the use of said second colorant is visually unobtrusive in the resulting pattern generated on said substrate.

30. The process of claim 29 wherein said substrate is a floor covering textile.

* * * * *